US008201537B2

(12) United States Patent
Scharp

(10) Patent No.: US 8,201,537 B2
(45) Date of Patent: Jun. 19, 2012

(54) MULTI-PART COOLED PISTON FOR AN INTERNAL COMBUSTION ENGINE

(75) Inventor: Rainer Scharp, Vaihingen (DE)

(73) Assignee: MAHLE International GmbH, Stuttgart (DE)

( * ) Notice: Subject to any disclaimer, the term of this patent is extended or adjusted under 35 U.S.C. 154(b) by 688 days.

(21) Appl. No.: 12/308,356

(22) PCT Filed: Jun. 8, 2007

(86) PCT No.: PCT/DE2007/001015

§ 371 (c)(1),
(2), (4) Date: Dec. 15, 2008

(87) PCT Pub. No.: WO2007/143969

PCT Pub. Date: Dec. 21, 2007

(65) Prior Publication Data

US 2011/0155080 A1 Jun. 30, 2011

(30) Foreign Application Priority Data

Jun. 13, 2006 (DE) ..... 10 2006 027 354

(51) Int. Cl.
*F02F 3/00* (2006.01)

(52) U.S. Cl. ..... 123/193.6

(58) Field of Classification Search ..... 92/220, 92/221, 186, 255, 256, 258, 216; 123/193.6, 123/41.35

See application file for complete search history.

(56) References Cited

U.S. PATENT DOCUMENTS 1,903,219 A 3/1933 Landis (Continued)

FOREIGN PATENT DOCUMENTS

DE 32 49 290 1/1984

(Continued)

OTHER PUBLICATIONS

International Search Report.

*Primary Examiner* — M. McMahon

(74) *Attorney, Agent, or Firm* — Collard & Roe, P.C.

(57) ABSTRACT

Proposed is a multi-part cooled piston (1) for an internal combustion engine, which piston (1) is composed of an upper piston part (2) and a lower piston part (6). The upper piston part (2) forms an inner annular cooling duct (11) with the lower piston part (6), which cooling duct (11) is covered by an upper region (31) of the lower piston part (6). The region (31) is of thin-walled design in such a way that it can be deformed in the manner of a plate spring. Simple and fast assembly of the upper piston part (2) on the lower piston part (6), and a fixed and secure screw connection between the two piston parts, result in that the upper piston part (2) is provided on its underside with a blind bore (26) which is arranged centrally and coaxially with respect to the piston axis (25) and has an internal thread (28), and in that the upper region (31) of the lower piston part (6) has a threaded bolt (29) which is arranged centrally and coaxially with respect to the piston axis (25), points upward and has an external thread (30), with the internal thread (28) matching the external thread (30), such that the upper piston part (2) can be screwed to the lower piston part (6) by means of the blind bore (26) and the threaded bolt.

1 Claim, 1 Drawing Sheet

U.S. PATENT DOCUMENTS

| | | | | |
|---|---|---|---|---|
| 2,024,269 | A | 12/1935 | Bernard | |
| 2,198,771 | A | 4/1940 | Hazen et al. | |
| 2,398,577 | A | 4/1946 | Bratzel | |
| 4,375,782 | A | 3/1983 | Schieber | |
| 5,975,040 | A * | 11/1999 | Silvonen et al. | 123/193.6 |
| 6,453,797 | B1 * | 9/2002 | Bauer | 92/186 |
| 6,729,291 | B1 | 5/2004 | Scharp et al. | |
| 2008/0011262 | A1 | 1/2008 | Scharp et al. | |

FOREIGN PATENT DOCUMENTS

| | | |
|---|---|---|
| DE | 37 19 469 | 12/1988 |
| DE | 41 31 275 | 3/1993 |
| DE | 102 57 022 | 6/2004 |
| DE | 10 2004 029 877 | 1/2006 |
| EP | 0 017 279 | 10/1980 |
| GB | 2 205 922 | 12/1988 |
| WO | WO 83/02300 | 7/1983 |
| WO | WO 2005/121537 | 12/2005 |
| WO | WO 2005/124136 | 12/2005 |

* cited by examiner

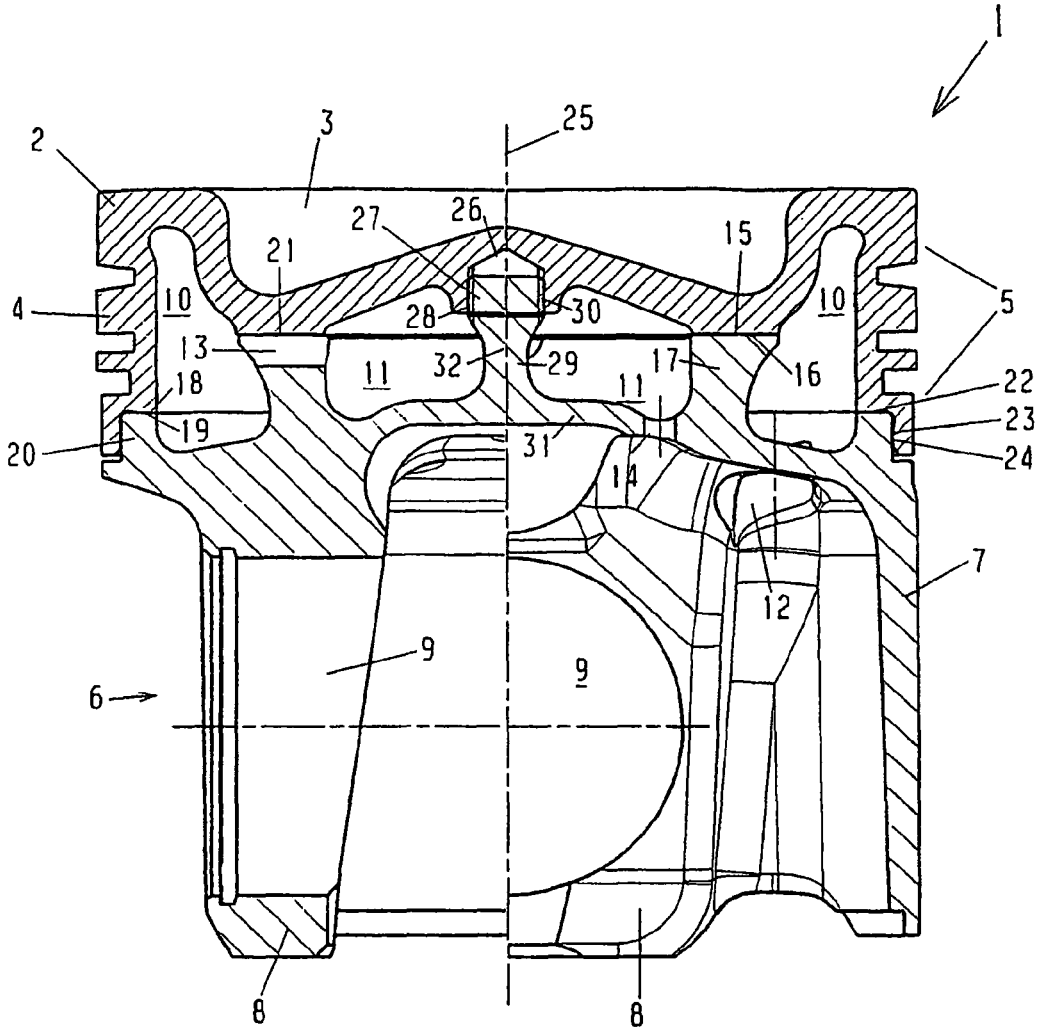
1
2
3
25
27
26
21
15
4
10
28
30
10
5
13
11
32
29
17
16
22
18
11
23
19
31
20
24
14
7
12
9
9
6
8
8

MULTI-PART COOLED PISTON FOR AN INTERNAL COMBUSTION ENGINE

CROSS REFERENCE TO RELATED APPLICATIONS

This application is the National Stage of PCT/DE2007/001015 filed on Jun. 8, 2007, which claims priority under 35 U.S.C. §119 of German Application No. 10 2006 027 354.0 filed on Jun. 13, 2006. The international application under PCT article 21(2) was not published in English.

The invention relates to a multi-part cooled piston for an internal combustion engine in accordance with the preamble of the claim.

A multi-part cooled piston for an internal combustion engine is known from the Offenlegungsschrift [version of patent published for public scrutiny] DE 102 57 022 A1; it consists of an upper piston part and a lower piston part. A threaded pin is disposed on the underside of the upper piston part, and a threaded bore is made in the upper region of the lower piston part, so that the two piston parts can be screwed together with one another by way of the threaded pin and the threaded bore. In this connection, the upper region of the lower piston part is configured to have such a thin wall that when the upper piston part and the lower piston part are screwed together, it deforms in the manner of a plate spring, so that a bias is exerted on the threaded pin and on the threaded bore, which strengthens and secures the screw connection formed in this manner. It is a disadvantage in this connection that during deformation of the upper region of the lower piston part, stress-related cracks can occur close to the threaded bore, which loosen the screw connection and can lead to damage to the piston and thus to the engine in which the piston is installed.

Proceeding from this, the invention is based on the task of avoiding the aforementioned disadvantage of the state of the art. This task is accomplished with the characteristics standing in the characterizing part of the claim.

Because of the fact that a threaded pin is formed onto the region of the lower piston part that has a thin wall and is deformable in the manner of a plate spring, the tensile circumference stresses that occur during assembly of the piston and the deformation of this region that occurs in this connection, in the direction of the piston crown, are reduced, thereby avoiding stress-related cracks in this region, to a great extent.

An exemplary embodiment of the invention will be described in the following, using the drawing. This shows a sectional diagram of the piston according to the invention, consisting of two halves, whereby the left half represents a half-section of the piston in the direction of the piston pin, and the right half represents a half-section of the piston in the major thrust/minor thrust direction.

The FIGURE shows a multi-part cooled piston 1 that consists of an upper piston part 2 having a combustion bowl 3 and having a ring wall 4 with ring belt 5, and of a lower piston part 6 that has a box-shaped piston skirt 7 and two pin bosses 8 connected with the latter, each having a pin bore 9 for accommodating a piston pin not shown in the FIGURE. The upper piston part 2 and the lower piston part 6 delimit an outer, ring-shaped cooling channel 10, and an inner cooling channel 11, disposed concentric to the former, whereby the outer cooling channel 10 has at least one inflow opening 12 for introducing cooling oil, and is connected with the inner cooling channel 11 by way of at least one overflow channel 13. The overflow channel 13 can be configured as a bore. The inner cooling channel 11 has at least one run-off bore 14, by way of which the cooling oil can exit from the inner cooling channel 11. The upper piston part 2 and the lower piston part 6 can be made from steel.

The upper piston part 2 is mounted, for one thing, on an upper contact surface 16 of a ring-shaped support rib 17 of the lower piston part 6 by way of a ring-shaped contact surface 15 that is disposed on the underside of the upper piston part, and for another, on a upper cross-sectional surface 19 of a ring-shaped support crosspiece 20 of the lower piston part 6, by way of a cross-sectional surface 18 situated on the underside of the ring wall 4. In this connection, the contact surfaces 15 and 16 form an inner, planar contact part 21, disposed horizontally or configured in roof-like or plate-like manner, and the cross-sectional surfaces 18 and 19 form an outer contact part 22 disposed coaxially and lying horizontally, or also configured in roof-like or plate-like manner.

Viewed in section, the support crosspiece 20 is configured as a step that is directed radially inward and upward, so that the upper piston part 2 can be centered, relative to the lower piston part 6, by way of a recess 23 made in the inside of the lower end of the ring wall 4 and shaped complementary to the support crosspiece 20, in that the recess 23 of the ring wall 4 of the upper piston part 2 is pushed onto the support crosspiece 20 of the lower piston part 6. In this connection, it is necessary that the inside diameter of the recess 23 is larger, by a certain tolerance dimension, than the outside diameter of the cylindrical face side 24 of the support crosspiece 20, so that problem-free assembly of the upper piston part 2 to the lower piston part 6 is guaranteed.

The underside of the upper piston part 2 has a dead-end bore 26 having an inside thread 28, disposed centered and coaxial to the piston axis 25. The region 31 between the ring-shaped support rib 17 of the lower piston part 6, which delimits the inner cooling channel 11, together with the upper piston part 2, is configured to have a relatively thin wall, and is provided, in its center, with a threaded pin 29 disposed coaxial to the piston axis 25 and directed upward, the upper end 27 of which pin has an outside thread 30 that fits into the inside thread 28 of the dead-end bore 26.

During assembly of the piston 1, the upper piston part 2 is centered relative to the lower piston part 6, by way of the recess 23 and the support crosspiece 20, and then rotated about the piston axis 25, whereby the dead-end bore 26 is screwed onto the threaded pin 29. In this connection, the elasticity of the relatively thin-walled region 31 brings about the effect that this region deforms when the upper piston part and lower piston part are screwed together, in the manner of a plate spring, i.e. that the inner center of the region 31, provided with the threaded pin 29, domes up in the direction of the upper piston part 2. In addition, the tensile stress exerted on the thread-free shaft 32 of the threaded pin 29 leads to elastic lengthening of the shaft 32. These deformations of both the region 31 and of the shaft 32 of the threaded pin 29 exert a bias on the screw connection 28, 30, which guarantees a firm screw connection between the upper piston part 2 and the lower piston part 6, particularly during engine operation.

REFERENCE SYMBOL LIST

1 piston
2 upper piston part
3 combustion bowl
4 ring wall
5 ring belt

6 lower piston part
7 piston skirt
8 pin boss
9 pin bore
10 outer cooling channel
11 inner cooling channel
12 inflow opening
13 overflow channel, bore
14 run-off bore
15 contact surface of the upper piston part 2
16 contact surface of the lower piston part 6
17 support rib
18 cross-sectional surface of the upper piston part 2
19 cross-sectional surface of the lower piston part 6
20 support crosspiece
21 inner contact part
22 outer contact part
23 recess of the ring wall 4
24 face side of the support crosspiece 20
25 piston axis
26 dead-end bore
27 end of the threaded pin 29
28 inside thread of the dead-end bore 26
29 threaded pin
30 outside thread of the threaded pin 29
31 region between the support rib 17
32 shaft of the threaded pin 29

The invention claimed is:

1. A multi-part cooled piston for an internal combustion engine, comprising:

an upper piston part having a ring wall with a ring belt;

a lower piston part having a box-shaped piston skirt and two pin bosses;

wherein the upper piston part together with the lower piston part forms an outer ring-shaped cooling channel and an inner ring-shaped cooling channel disposed concentric to the outer ring-shaped cooling channel, wherein the inner cooling channel is covered by an upper region of the lower piston part, which is configured to have such a thin wall that it can be deformed in the manner of a plate spring, wherein an underside of the upper piston part has a dead-end bore having an inside thread, disposed centered and coaxial to a piston axis, wherein a threaded pin is formed into an upper region of the lower piston part, said threaded pin having an outside thread and being disposed centered and coaxial to the piston axis and directed upward, and wherein the inside thread fits onto the outside thread, so that the upper piston part can be screwed together with the lower piston part by screwing the threaded pin into the dead-end bore.

* * * * *